United States Patent [19]

Hoskins, Jr.

[11] 4,407,072

[45] Oct. 4, 1983

[54] THIN FLANGE AND LOOSE WHEEL DETECTION SYSTEM

[75] Inventor: Paul T. Hoskins, Jr., Spencer, N.C.

[73] Assignee: Southern Railway Company, Washington, D.C.

[21] Appl. No.: 321,129

[22] Filed: Nov. 13, 1981

[51] Int. Cl.[3] ..... B61K 9/12; B61L 11/02

[52] U.S. Cl. ..... 33/203.11; 246/219; 246/169 R; 73/146; 33/148 H

[58] Field of Search ..... 33/203, 203.11, 148 H, 33/149 J, 147 N, 144, 146, 172 E, 174 L, 174 P; 73/146; 246/219, 169, 246 V, 247

[56] References Cited

U.S. PATENT DOCUMENTS

| | | | |
|---|---|---|---|
| 2,408,553 | 10/1946 | Gieskieng et al. | 73/146 X |
| 2,442,491 | 6/1948 | Gieskieng et al. | 246/219 X |
| 2,507,896 | 5/1950 | Frank | 33/144 |
| 2,579,569 | 12/1951 | Hauck et al. | 33/147 N |
| 3,188,464 | 6/1965 | Gieskieng | 246/169 R X |
| 3,333,097 | 7/1967 | Jamison et al. | 246/169 R |
| 3,474,542 | 10/1969 | Walton | 33/203.11 |
| 3,507,046 | 4/1970 | Smith et al. | 33/149 R |
| 3,938,254 | 2/1976 | Miller | 33/203.11 |

*Primary Examiner*—Harry N. Haroian

*Attorney, Agent, or Firm*—Watson, Cole, Grindle & Watson

[57] ABSTRACT

A system for detecting a thin wheel flange and condition and a loose wheel condition of railroad wheels includes relatively movable contacts actuated by the passing wheels and triggering switches when the contacts move together into a spacing less than a predetermined flange thickness. Opposing contact arms bearing against back faces of the rims of the opposing wheels are interconnected for detecting a loose wheel condition upon the closing of an electrical circuit including microswitches and electrical contacts which close when the opposing wheels are spaced less than a predetermined distance apart.

10 Claims, 5 Drawing Figures

THIN FLANGE AND LOOSE WHEEL DETECTION SYSTEM

BACKGROUND OF THE INVENTION

This invention relates generally to a system for detecting defective wheels of a railroad car while the train is moving, and more particularly to such a system for automatically detecting a thin flange condition as well as a loose wheel condition of the railroad car.

A "thin flange" wheel condition referred to herein relates to the thickness of a wheel flange reduced through wear or faulty manufacture from a predetermined flange thickness of 1.0 inch minimum measured from the back face of the rim of the wheel to a typical gauging point on the flange. Such a gauging point is shown in U.S. Pat. No. 3,938,254, for example, as determined with the use of a standard manual gauge (Association of American Railroads steel wheel gauge). And, a "loose wheel" or "slipped wheel" condition described herein refers to slippage of a railroad car wheel relative to its axle. In such condition, railroad car wheels of an opposed pair shift closer together than the prescribed minimum distance of 53 inches prescribed by the AAR. The permissible spacing between back faces of the rims of opposed wheels is 53 to 53⅜ inches.

Manual wheel flange gauges of the type described in the aforementioned patent, and manual measurements are customarily taken to gauge the thin flange and loose wheel conditions during an immobile condition of the railroad car in the yard. Such manual gauging and measurement techniques are manifestly laborious and time consuming and not sufficiently accurate because of human error involved.

SUMMARY OF THE INVENTION

It is therefore an object of the present invention to provide a system for detecting a thin flange condition which is fully automatic, accurate, reliable and expeditious as it automatically measures an unacceptably reduced flange thickness while the train is moving.

Another object of the invention is to provide such a system which includes a detector device having a pair of relatively movable contacts for respectively bearing against the inner face of the wheel flange and the back face of the rim of the wheel, switch means being actuated upon relative movement of the contacts toward one another to a spacing which is less than the predetermined wheel flange thickness. A signal device is triggered upon actuation of the switch.

A further object of this invention is to provide such a system wherein relative movement of the contacts is effected upon a passing by the railroad wheel being measured.

A still further object of the present invention is to provide such a system wherein a depressible operating element effects movement of an inner face contact arm upon a passing by of the wheel, and a magnetic proximity switch is actuated by the passing wheel to effect movement of a back face contact arm, both arms having contact elements brought to bear against the inner face of the flange and the back face of the rim.

A still further object of this invention is to provide such a system wherein opposed detector devices are arranged for simultaneously detecting thin flange conditions of opposed pairs of railroad car wheels during train movement.

A still further object is to provide a system for detecting a loose flange condition by the provision of a connecter having relatively movable parts extending between the back face contact arms, and elements of an electrical circuit on the connector parts and on the contact arms closing the circuit for triggering a signal when the opposed wheels are spaced apart a distance less than a predetermined spacing.

A still further object is to provide such a loose wheel condition detecting system wherein such elements comprise button switches on the arms which close upon contacting the back faces of the rims, and metallic contacts on the relatively movable parts which overlap during such loose wheel condition.

Other objects, advantages and novel features of the invention will become more apparent from the following detailed description of the invention when taken in conjunction with the accompanying drawings.

DETAILED DESCRIPTION OF THE INVENTION

Figure 1:
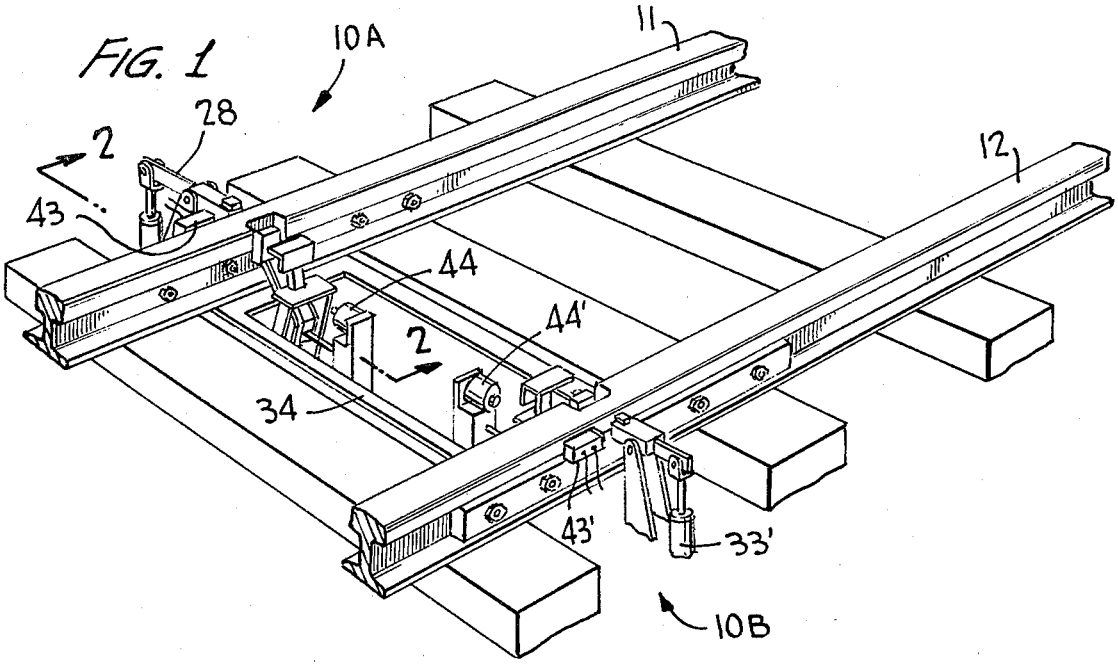
FIG. 1 is a perspective view of the rails of a railroad track incorporating the detecting system of the invention.
Figure 2:
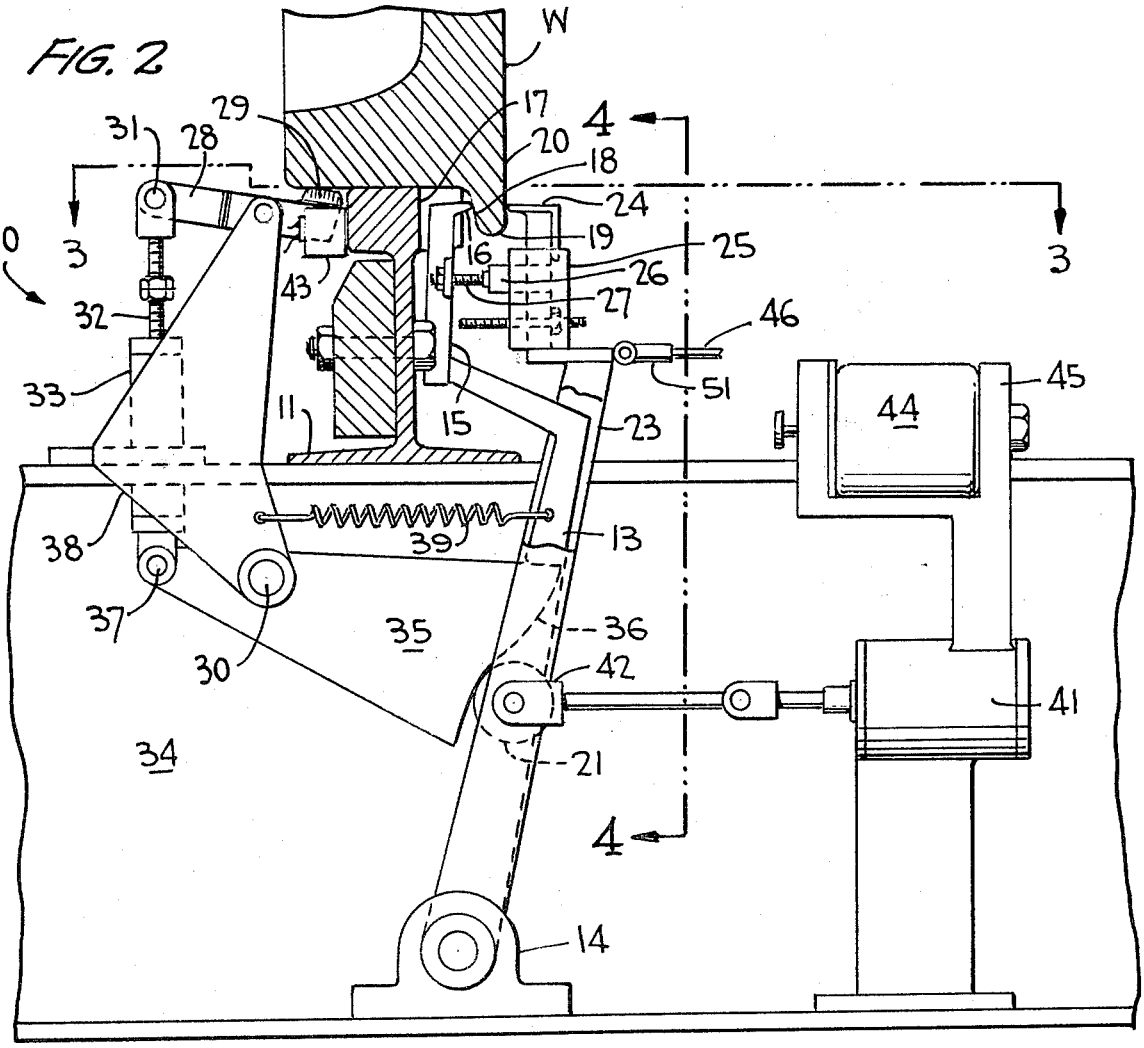
FIG. 2 is an enlarged side elevation of the thin flange detecting apparatus according to the invention, taken substantially along the line 2—2 of FIG. 1.

Turning now to the drawings wherein like reference characters refer to like and corresponding parts throughout the several views, the thin flange detector of the invention, generally designated 10 in FIG. 2, may be suitably arranged for operation in pairs as 10A and 10B in FIG. 1 in relation to a pair of rails 11 and 12 of a railroad track. Detector 10B is a mirror image of 10A, so that the detector will be described specifically with reference to FIGS. 2 to 4, and similar elements of detector 10B will be identified with a prime (').

A contact arm, in the form of spaced plates 13, is journalled at its lower end in a block bearing 14, and has at its upper end a contact bar 15 terminating in a contact element 16 which extends from a notch 17 provided in rail 11. Contact element 16 is arranged to bear against an inner face 18 of wheel flange 19. As more clearly shown in FIG. 4, the spaced plates of contact arm 13 have a cam idler roller 21 mounted on an axle 22 therebetween.

Another contact arm 23, comprising a pair of spaced plates (FIG. 4), is likewise journalled at its lower end in block bearing 14 and terminates at its upper end in a contact element 24 mounted on a support 25. A button microswitch 26 extends from support 25 and confronts an axially adjustable stud 27 mounted to one side on contact bar 15. Microswitch 26 is series connected into an electrical circuit which, when closed as contact between elements 26 and 27 trips the microswitch, triggers a signal such as an alarm which sounds in the hump inspector's inspection pit.

Figure 3:
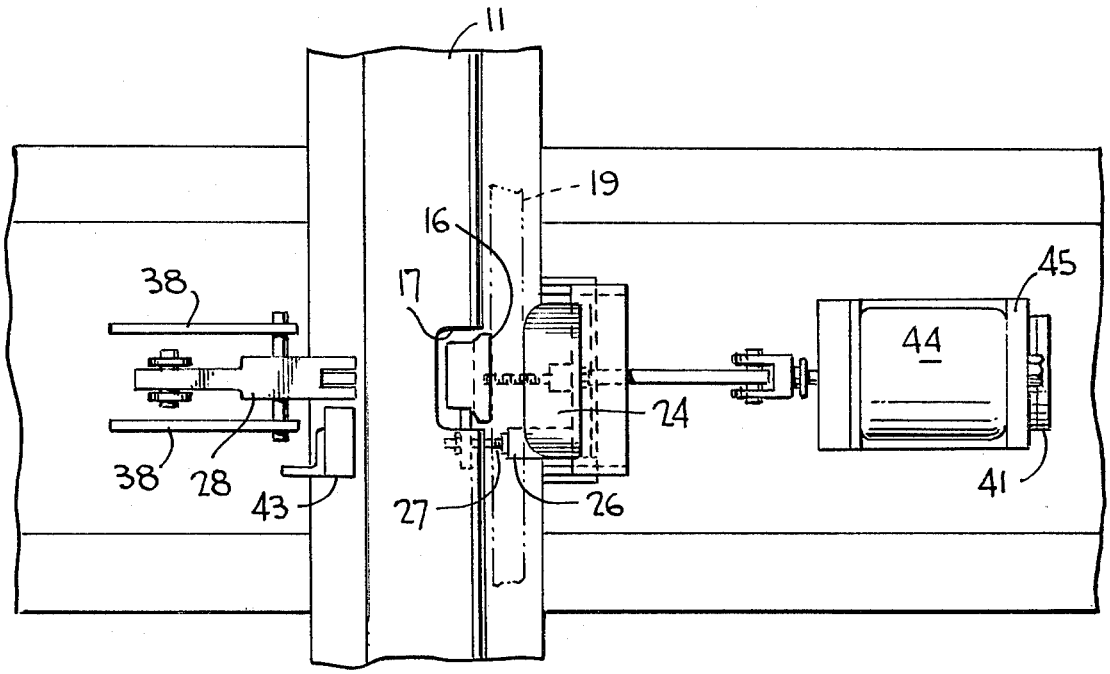
FIG. 3 is a top plan view of the FIG. 2 apparatus taken substantially along the line 3—3 of FIG. 2.
Figure 4:
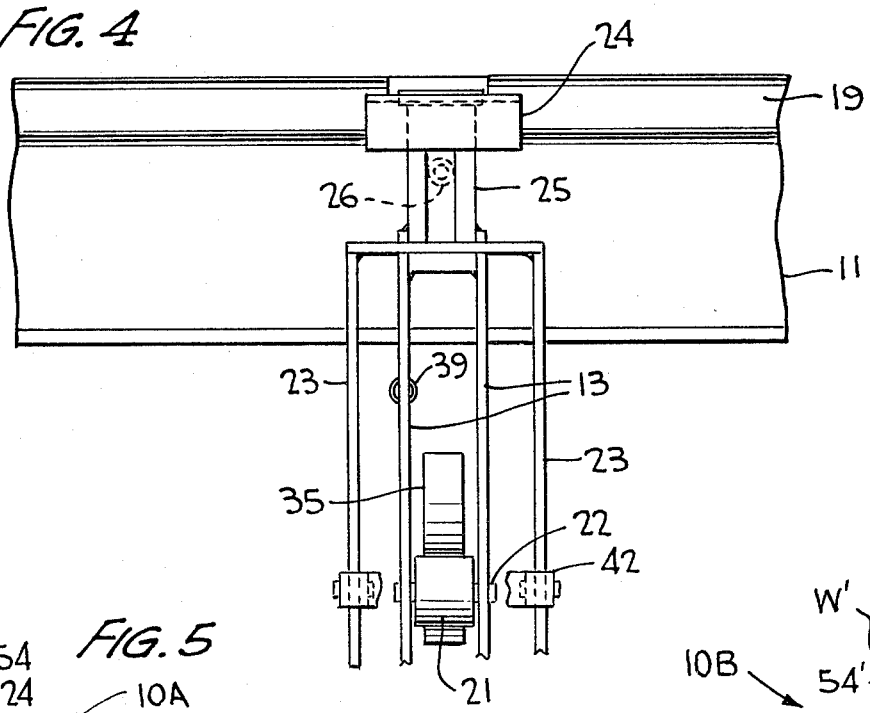
FIG. 4 is an end elevational view of the FIG. 2 apparatus taken substantially along the line 4—4 of FIG. 2.

The contact arms are relatively movable toward one another into the position of FIGS. 2 and 3 by the wheel W as it moves by detector 10. Such relative movement is effected by the provision of an operating lever 28 having an impact bearing 29 at its free end elevated above the top of the rail and adjacent thereto. The operating lever is depressible by the wheel tread as it moves along the rail, and is anchored as at 31 to a spring biased operating rod 32 which extends outwardly of a casing 33 mounted on a base support 34 of the detector. A cam element 35, having a cam face 36, is pivoted as at 30 and pin 37 connects it to the lower end of rod 32 and bears against cam roller 21. A linkage element 38 is pivotally connected at opposite ends to lever 28 and cam 35, and is interconnected with contact arm 13 by a tension spring 39.

An air cylinder 41 mounted on base support 34 has at the end of its piston rod a clevis 42 pivotally mounted to contact arms 23 for movement thereof toward and away from back face 20 of the rim of the wheel. The air cylinder is actuated through a proximity limit switch 43 supported beneath the wheel tread adjacent operating arm 28. Switch 43 is magnetically actuated by the outer tread of the wheel as it passes by, through an electronic control box (not shown) to a magnetic coil 44 that actuates an air valve 45 of the air cylinder.

In operation, contact arms 13 and 23 are initially in an open position such that their contact elements 16 and 24 are spaced apart slightly greater than $2\frac{1}{2}$ inches so as to accommodate an unworn and undefective wheel flange in the $56\frac{1}{2}$ inch track gauge. The operating lever 28 is initially raised at its bearing 29 end above the top of the rail under the action of spring 39 and elements 38, 35 which likewise urge the upper end of contact bar 15 against the root of notch 17. Magnetic coil 44 is also deenergized in this initial position thereby causing the piston rod of air cylinder 41 to retract. As wheel W of the moving train passes by detector 10, its outer tread depresses lever 28 upon impact against bearing 29. Linkage plate 38 transmits this downward pivotal movement to cam 35 causing it to likewise downwardly pivot about its end 37 whereupon cam face 36 moves along cam roller 21 causing contact arm 13 to pivot clockwise about bearing 14 until its contact element 16 bears against inner face 18 of flange 19. At the same time, the passing wheel energizes magnetic coil 44 through an electronic control box actuated by proximity limit switch 43. The coil actuates air valve 45 causing the plunger rod of the air cylinder to extend to move contact arm 23 counterclockwise about bearing 14 until its contact element 24 bears against back face 20 of the rim of the wheel. For detecting a thin flange condition, stud 27 is adjusted to impact against microswitch 26 when wheel flange 19 is reduced to a thickness of the 15/16 inch or less. A thin flange condition is shown in FIG. 2 wherein microswitch 26 is actuated as contact elements 16 and 24 move relatively toward one another to a spacing less than one inch apart. A signal device (not shown) is electrically connected with the microswitch and is located in the hump inspector's inspection pit. The signal device, which may be an audio and/or visual alarm, is triggered by the microswitch when actuated to alert the inspector of a thin flange condition.

The present invention permits a pair of opposed detectors 10A and 10B to be installed along the track as shown in FIG. 1 so that an opposed pair of railroad wheels may be simultaneously detected for a thin flange condition. Both microswitches may be connected in series with a common signal device which, when triggered, alerts the inspector to a thin wheel flange condition for a particular railroad car. It is then but an easy task to manually inspect the wheels of the car to identify the defective wheel or wheels. Of course, detector 10B operates in an identical manner as described with reference to FIGS. 2 to 4.

Figure 5:
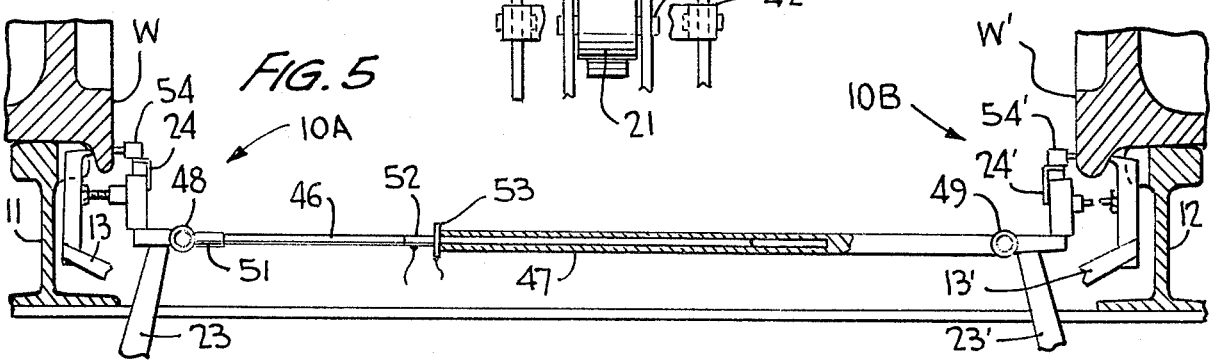
FIG. 5 is a side elevational view of the loose wheel detecting apparatus according to the invention incorporated into the FIG. 2 apparatus.

The thin flange detector according to the invention likewise facilitates loose wheel detection, with an arrangement shown in FIG. 5, as made possible by the opposed relationship of a pair of thin flange detectors. To detect a loose or slipped wheel condition, it is necessary to measure or gauge the distance between the back faces 20,20' of a pair of wheels. To gauge this distance, a pair of telescoping plastic rods 46, 47 are hingedly mounted at opposite ends as at 48, 49 respectively to contact arms 23 and 23' of detectors 10A and 10B. Rod 46 is hingedly mounted via an internally threaded sleeve 51 to facilitate longitudinal adjustment of the rod. And, rod 46 has a metallic sleeve 52 or the like fixed between its ends adjacent a metallic annular ring 53 fixed at the free end of rod 47 and having an inner diameter equal to the outer diameter of sleeve 52 capable of sliding therethrough. And, button microswitches 54 and 54' are respectively mounted on contact elements 24 and 24' for actuation upon impact against back faces 20 and 20' of wheels W and W'. The extent of rod 46 is adjusted relative to rod 47 such that metallic contacts 52 and 53 are set to overlap and make contact when the distance between the tips of contact elements 24 and 24' is 52 15/16 inch or less. Thus, at a spacing of 53 inches or more, contacts 52 and 53 will remain spaced slightly apart. These contacts, together with microswitches 54 and 54' are series connected into an electrical circuit which, when closed, triggers a signal device (not shown) to alert the inspector to a loose wheel condition. Microswitches 54 and 54' close the circuit each time they impact against the back faces of the opposed wheels, although the circuit is not completely closed for triggering the signal device until contact is made between metallic elements 52 and 53.

Thus, in operation, as a pair of opposed railroad wheels pass by the detector, the outer treads thereof effect movement of contact arms 23 and 23' until their contact elements 24 and 24' bear against back faces 20 and 20' of the rims of the wheels, all as described in detail hereinabove. Microswitches 54 and 54' simultaneously close upon impact against 20 and 20' and, if the spacing between the back faces of the opposing wheel rims is 52 15/16 inches or less, contact is made between elements 52 and 53 to complete the closing of the circuit whereupon a time delay relay coil (not shown) in series connection therewith is energized so that interlocks on this relay actuate a signal device in the hump car inspectors pit for alerting the inspector to a slipped wheel condition. Of course, when microswitches 54 close as they bear against back faces 20 spaced a minimum distance of 53 inches apart, no contact is made between elements 52 and 53, the circuit remains open and the signal device is not triggered.

From the foregoing, it can be seen that a simple and effective, yet highly reliable and fully automatic detector system has been devised for detecting both a thin flange condition as well as a loose wheel condition while the train moves along the track.

Obviously, many modifications and variations of the present invention are made possible in the light of the above teachings. It is therefore to be understood that within the scope of the appended claims the invention may be practiced otherwise than as specifically described.

What is claimed is:

1. A system for detecting the thickness of a flange of a railroad wheel which is reduced from a predetermined thickness, comprising a pair of relatively movable contact means for respectively bearing against the inner face of the flange and the back face of the rim of the railroad wheel, means for operating said contact means to effect said relative movement thereof upon a passing by of said wheel, switch means actuated upon relative movement of said contact means toward one another to a spacing which is less than said predetermined thickness, and means connected to said switch means for signalling a reduced flange thickness condition upon said relative movement.

2. The system according to claim 1, wherein said contact means comprise a pair of pivotally mounted contact arms having opposing contact elements.

3. The system according to claim 1, wherein said contact means comprise a pair of contact arms having contact elements, and said operating means comprises a depressible operating element for effecting movement of said inner face contact arm upon the passing by of said railroad wheel.

4. The system according to claim 1, wherein said operating means further includes a magnetic switch for effecting movement of said back face contact means upon the passing by of said railroad wheel.

5. A system for detecting a reduced flange thickness condition from a predetermined flange thickness of opposed pairs of railroad wheels moving along the rails of a railroad track, comprising two pairs of contact means, one of said pairs being adapted to bear against the inner faces of the flanges and the other of said pairs being adapted to bear against the back faces of the rims of the wheels, said one and said other contact means of said pairs being relatively movable, means for operating said contact means to effect said relative movements thereof upon a passing by of said wheels switch means actuated upon relative movement toward one another of said contact means of said pairs to spacings less than said predetermined wheel flange thicknesses, and means connected to said switch means for signalling a reduced flange thickness condition upon said relative movements.

6. The system according to claim 5, wherein said contact means comprise contact arms having contact elements thereon, and said operating means comprise depressible operating elements for effecting movement of said inner face contact means upon the passing by of the wheels.

7. The system according to claim 5 or 6, wherein said operating means further include magnetic switches for effecting movement of said back face contact means upon the passing by of the wheels.

8. A system for detecting a reduced flange thickness condition from a predetermined flange thickness of opposed pairs of railroad wheels moving along the rails of a railroad track, comprising two pairs of contact means, one of said pairs being adapted to bear against the inner faces of the flanges and the other of said pairs being adapted to bear against the back faces of the rims of the wheels, said one and said other contact means of said pairs being relatively movable, a connector having relatively movable parts extending between said back face contact means of said pairs, means on said connector parts and on said back face contact means defining an electrical circuit which closes in response to a loose wheel condition in which an opposed pair of wheels is spaced less than a predetermined distance apart switch means actuated upon relative movement toward one another of said contact means of said pairs to spacings less than said predetermined wheel flange thicknesses, and means connected to said switch means for signalling a reduced flange thickness condition upon said relative movements.

9. A system for detecting a loose wheel condition in which an opposed pair of railroad wheels are spaced apart a distance less than a predetermined spacing, comprising a pair of back face contact means for bearing against the back faces of the rims of the opposed wheels, a connector having relatively movable parts extending between said contact means, means on said connector parts and on said contact means defining an electrical circuit which closes when the opposed wheels are spaced apart a distance less than the predetermined spacing said circuit defining means comprising button switches on said back face contact means which close upon contacting the back faces of the rims, and initially spaced contacts on said relatively movable parts which overlap in said loose wheel condition.

10. A system for detecting a loose wheel condition in which an opposed pair of railroad wheels are spaced apart a distance less than a predetermined spacing, comprising a pair of back face contact means for bearing against the back faces of the rims of the opposed wheels, a connector having relatively movable parts extending between said contact means, said relatively movable parts comprising telescoping non-conductive rods, said contacts comprising a metallic element and a metallic disc on said rods means on said connector parts and on said contact means defining an electrical circuit which closes when the opposed wheels are spaced apart a distance less than the predetermined spacing.

* * * * *